US010593265B2

(12) United States Patent
Li et al.

(10) Patent No.: US 10,593,265 B2
(45) Date of Patent: Mar. 17, 2020

(54) COMPENSATION CIRCUIT IN WHICH A MAGNITUDE RELATIONSHIP BETWEEN CHANNEL WIDTH-TO-LENGTH RATIOS OF DRIVING TRANSISTORS OF ANY TWO SUB-PIXELS IS IDENTICAL WITH A MAGNITUDE RELATIONSHIP BETWEEN CHANNEL WIDTH-TO-LENGTH RATIOS OF TWO SENSE TRANSISTORS CORRESPONDING TO THE TWO SUB-PIXELS, MANUFACTURING METHOD THEREOF, PIXEL CIRCUIT, COMPENSATION DEVICE AND DISPLAY DEVICE

(71) Applicant: BOE TECHNOLOGY GROUP CO., LTD., Beijing (CN)

(72) Inventors: Quanhu Li, Beijing (CN); Song Meng, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/080,466

(22) PCT Filed: Jan. 16, 2018

(86) PCT No.: PCT/CN2018/072753
§ 371 (c)(1),
(2) Date: Aug. 28, 2018

(87) PCT Pub. No.: WO2019/000914
PCT Pub. Date: Jan. 3, 2019

(65) Prior Publication Data

US 2019/0259327 A1 Aug. 22, 2019

(30) Foreign Application Priority Data

Jun. 26, 2017 (CN) ..... 2017 1 0495186

(51) Int. Cl.
*G09G 3/3233* (2016.01)
*G09G 3/3225* (2016.01)

(52) U.S. Cl.
CPC ..... *G09G 3/3233* (2013.01); *G09G 3/3225* (2013.01); *G09G 2300/043* (2013.01);
(Continued)

(58) Field of Classification Search
CPC combination set(s) only.
See application file for complete search history.

(56) References Cited

U.S. PATENT DOCUMENTS

2003/0197666 A1* 10/2003 Akimoto ..... G09G 3/3233 345/82
2008/0048947 A1* 2/2008 Liu ..... G09G 3/3233 345/77

(Continued)

FOREIGN PATENT DOCUMENTS

CN 1705001 A 12/2005
CN 1741117 A 3/2006

(Continued)

OTHER PUBLICATIONS

International Search Report and Written Opinion dated Apr. 13, 2018 from State Intellectual Property Office of the P.R. China.

*Primary Examiner* — Lisa S Landis
(74) *Attorney, Agent, or Firm* — Dilworth & Barrese, LLP.; Michael J. Musella, Esq.

(57) ABSTRACT

A compensation circuit and a manufacturing method thereof, a pixel circuit, a compensation device and a display device are disclosed. The OLED compensation circuit includes at least two sense transistors, the at least two sense transistors are in one-to-one correspondence with at least two sub-pixels in a pixel, and a first electrode of each of the sense transistors is electrically connected to a driving transistor of corresponding one of the sub-pixels; a magnitude relation- (Continued)

ship between channel width-to-length ratios of driving transistors of any two sub-pixels of the at least two sub-pixels is identical with a magnitude relationship between channel width-to-length ratios of two sense transistors corresponding to the two sub-pixels.

20 Claims, 6 Drawing Sheets

(52) U.S. Cl.
CPC ..... *G09G 2300/0819* (2013.01); *G09G 2300/0842* (2013.01); *G09G 2320/0295* (2013.01); *G09G 2320/043* (2013.01)

(56) References Cited

U.S. PATENT DOCUMENTS

| | | | |
|---|---|---|---|
| 2013/0181967 | A1 | 7/2013 | Lee et al. |
| 2018/0137824 | A1 | 5/2018 | Uchino et al. |

FOREIGN PATENT DOCUMENTS

| | | | |
|---|---|---|---|
| CN | 103208253 | A | 7/2013 |
| CN | 107134258 | A | 9/2017 |

* cited by examiner

COMPENSATION CIRCUIT IN WHICH A MAGNITUDE RELATIONSHIP BETWEEN CHANNEL WIDTH-TO-LENGTH RATIOS OF DRIVING TRANSISTORS OF ANY TWO SUB-PIXELS IS IDENTICAL WITH A MAGNITUDE RELATIONSHIP BETWEEN CHANNEL WIDTH-TO-LENGTH RATIOS OF TWO SENSE TRANSISTORS CORRESPONDING TO THE TWO SUB-PIXELS, MANUFACTURING METHOD THEREOF, PIXEL CIRCUIT, COMPENSATION DEVICE AND DISPLAY DEVICE

The present application claims priority to Chinese patent application No. 201710495186.6, filed on Jun. 26, 2017, the entire disclosure of which is incorporated herein by reference as part of the present application.

TECHNICAL FIELD

Embodiments of the present disclosure relate to a compensation circuit, a manufacturing method thereof, a pixel circuit, a compensation device and a display device.

BACKGROUND

Active-matrix organic light emitting diode (AMOLED) display panels are increasingly used in high-performance display devices as current-type light-emitting devices. Due to its self-illuminating property, an AMOLED display has many advantages such as a wider color gamut, higher contrast, being ultra-thin and ultra-light compared with a liquid crystal display (LCD).

SUMMARY

At least one embodiment of the present disclosure provides a compensation circuit, the compensation circuit comprises at least two sense transistors, and the at least two sense transistors are in one-to-one correspondence to at least two sub-pixels in a pixel, and a first electrode of each of the sense transistors is electrically connected to a driving transistor of corresponding one of the sub-pixels; and a magnitude relationship between channel width-to-length ratios of driving transistors of any two sub-pixels of the at least two sub-pixels is identical with a magnitude relationship between channel width-to-length ratios of two sense transistors corresponding to the two sub-pixels.

In an implementation of the embodiment of the present disclosure, the compensation circuit further comprises a sense line, the sense line is configured to be electrically connected to driving transistors of the at least two sub-pixels, each of the sense transistors is electrically connected between the driving transistor of the corresponding one of the sub-pixels and the sense line, and the sense line is configured to provide a reference voltage to a second electrode of each of the sense transistors.

In an implementation of the embodiment of the present disclosure, a ratio between the channel width-to-length ratios of the driving transistors of the two sub-pixels is A, and a ratio between the channel width-to-length ratios of the two sense transistors corresponding to the two sub-pixels is in a range of [A−a, A+a], where A is a positive number, and $|A-1|>a>0$.

In an implementation of the embodiment of the present disclosure, colors of light emitted by the two sub-pixels are different from each other.

At least one embodiment of the present disclosure provides a method of manufacturing a compensation circuit, the method comprises: determining channel width-to-length ratios between driving transistors of at least two sub-pixels in a pixel; determining channel width-to-length ratios of at least two sense transistors based on the channel width-to-length ratios of the driving transistors of the at least two sub-pixels, wherein the at least two sense transistors are in one-to-one correspondence to the at least two sub-pixels, a first electrode of each of the sense transistors is electrically connected to a driving transistor of corresponding one of the sub-pixels, and a magnitude relationship between channel width-to-length ratios of driving transistors of any two sub-pixels of the at least two sub-pixels is identical with a magnitude relationship between channel width-to-length ratios of two sense transistors corresponding to the two sub-pixels; and manufacturing the at least two sense transistors based on the determined channel width-to-length ratios of the at least two sense transistors.

In an implementation of the embodiment of the present disclosure, the driving transistors of the at least two sub-pixels are electrically connected to a same sense line, each of the sense transistors is electrically connected between the driving transistor of the corresponding one of the sub-pixels and the sense line, and the sense line is configured to provide a reference voltage to a second electrode of each of the sense transistors.

In an implementation of the embodiment of the present disclosure, a ratio between the channel width-to-length ratios of the driving transistors of the two sub-pixels is A, and a ratio between the channel width-to-length ratios of the two sense transistors corresponding to the two sub-pixels is in a range of [A−a, A+a], where A is a positive number, and $|A-1|>a>0$.

In another implementation of the embodiment of the present disclosure, the at least two sense transistors comprise a first sense transistor and a second sense transistor, the method further comprises: taking values sequentially in [A−a, A+a] by a set step size; designing analog circuits by sequentially using each of the values as a ratio between a channel width-to-length ratio of the first sense transistor and a channel width-to-length ratio of the second sense transistor, wherein in each of the analog circuits, a ratio of a channel width-to-length ratio of a first driving transistor corresponding to the first sense transistor to a channel width-to-length ratio of a second driving transistor corresponding to the second sense transistor is A; and determining an optimal ratio among the values by adopting the analog circuit.

In another implementation of the embodiment of the present disclosure, determining the optimal ratio among the values by adopting the analog circuits comprises: writing a data voltage group to the first driving transistor and the second driving transistor respectively for each ratio, wherein the data voltage group comprises a plurality of different data voltages; obtaining a source voltage group of the first driving transistor corresponding to the data voltage group and a source voltage group of the second driving transistor corresponding to the data voltage group; generating a curve between the data voltage group and the source voltage group of the first driving transistor and a curve between the data voltage group and the source voltage group of the second driving transistor respectively; and selecting a ratio corresponding to a case that the two curves have highest coincidence degree as the optimal ratio among the values.

In another implementation of the embodiment of the present disclosure, writing the data voltage group to the first driving transistor and the second driving transistor respectively for each ratio comprises: determining a reference voltage group corresponding to the data voltage group based on a correspondence between the data voltages and reference voltages; and writing a reference voltage corresponding to a data voltage of the data voltage group to the sense line upon writing the data voltage to the first driving transistor and the second driving transistor respectively.

At least one embodiment of the present disclosure provides a pixel circuit, the pixel circuit comprises the compensation circuit according to any one of the embodiments of the present disclosure and driving transistors of the at least two sub-pixels which are in one-to-one correspondence with the at least two sense transistors.

In an implementation of the embodiment of the present disclosure, each of the at least two sub-pixels further comprises: a data writing transistor and a capacitor, the data writing transistor is configured to write a data voltage to a gate electrode of a driving transistor corresponding to the data writing transistor, and the capacitor is configured to store the data voltage and maintain the data voltage at the gate electrode of the driving transistor corresponding to the capacitor.

In another implementation of the embodiment of the present disclosure, in each of the at least two sub-pixels, a first electrode of the driving transistor is electrically connected to a first electrode of a sense transistor corresponding to the driving transistor, and a second electrode of the driving transistor is electrically connected to a first power supply, and a gate electrode of the driving transistor is electrically connected to a first electrode of the data writing transistor; a gate electrode of the data writing transistor is electrically connected to a gate line, a second electrode of the data writing transistor is configured to receive the data voltage; and a terminal of the capacitor is electrically connected to the first electrode of the driving transistor, and a remaining terminal of the capacitor is electrically connected to the gate electrode of the driving transistor.

At least one embodiment of the present disclosure provides a compensation device, the compensation device comprises a control circuit and the compensation circuit according to any one of embodiments of the present disclosure, wherein the control circuit is electrically connected to the compensation circuit.

In an implementation of the embodiment of the present disclosure, the control circuit comprises an integrated circuit chip.

At least one embodiment of the present disclosure provides a display device, the display device comprises the pixel circuit according to any one of embodiments of the present disclosure or the compensation device according to any one of embodiments of the present disclosure.

BRIEF DESCRIPTION OF THE DRAWINGS

In order to clearly illustrate the technical solutions of the embodiments of the disclosure, the drawings of the embodiments will be briefly described in the following; it is obvious that the described drawings are only related to some embodiments of the disclosure and thus are not limitative to the disclosure.

DETAILED DESCRIPTION

Figure 1:
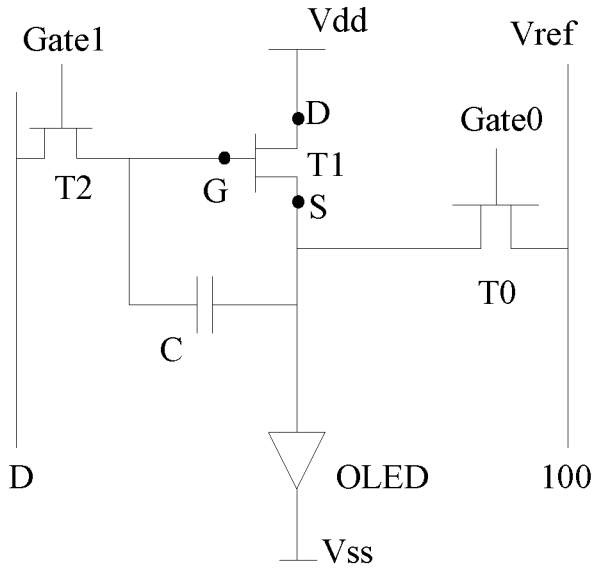
FIG. 1 is a circuit diagram of a compensation circuit provided by an embodiment of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

The threshold voltage of a thin film transistor (TFT) in an AMOLED display panel may drift under conditions such as applying a voltage for a long time and high temperature. To display different images, data voltages to be applied are different, and the drifting amounts of the threshold voltages of driving TFTs of different parts in the display panel are different, thereby causing difference in display brightness. Because the difference in brightness is related to previously displayed images, the AMOLED display panel exhibits an afterimage phenomenon, that is, afterimage.

At present, in order to solve the afterimage problem of the display panel, a compensation technology is adopted in addition to the improvement of the process. There exists a method in which the electrical characteristics of a pixel is sensed by a driving chip and compensated. In this compensation method, a sense circuit of a driving chip extracts an electrical signal of a driving transistor in a pixel, calculates a driving voltage value to be compensated by means of an integrated circuit chip, and feeds the driving voltage value to be compensated back to the driving chip, so as to implement compensation.

In order to detect the electrical signal of the drive transistor, a sense line is typically placed in each pixel, and the sense line is simultaneously connected to all sub-pixels in the pixel. Each of the sub-pixels is correspondingly provided with a sense transistor, and the sense line is connected between a source electrode of the driving transistor of a sub-pixel and an OLED device through the sense transistor corresponding to the sub-pixel.

The sense line can provide a reference voltage to the source electrode of the driving transistor during the data writing phase in addition to extracting the electrical signal, thereby ensuring that gate-source voltages of respective driving transistors in the pixel are identical. For example, in the data writing phase, the sense transistor is turned on and the sense line provides the reference voltage to the source electrode of the driving transistor.

In an OLED display panel, sub-pixels of different colors may need different light-emitting currents to ensure that sub-pixels of different colors can emit light of the same brightness with the same data voltage. In order to ensure that different color sub-pixels can obtain different light-emitting currents, the sub-pixels of different colors need to adopt driving transistors with different channel width-to-length ratios when designing pixels. Because all the sense transistors in each pixel are identical, the channel width-to-length ratios of the sense transistors corresponding to all the sub-pixels in one pixel are identical, and the equivalent resistances of the sense transistors are identical. However, the channel width-to-length ratios of the driving transistors are different, and thus the equivalent resistances of the driving transistors are different.

For example, in the data writing phase, the equivalent resistor of the driving transistor and the equivalent resistor of the sense transistor are connected in series, and the voltages applied at two ends of the two equivalent resistors connected in series are a power supply voltage and a reference voltage respectively, and the power supply voltage and the reference voltage are fixed for different sub-pixels. In the event that the equivalent resistances of the driving transistors are different and the equivalent resistances of the sense transistor are identical, voltages obtained by different driving transistors are obviously different. That is, source voltages of the driving transistors with different channel width-to-length ratios are obviously different, which results in that gate-source voltages of different driving transistors have large difference when the same data voltage is applied to different driving transistors, and thus the actual light-emitting current does not meet the design requirements.

It should be noted that in the embodiments of the present disclosure, the source electrode and the drain electrode of a transistor used here may be symmetrical in structure, so the source electrode and the drain electrode may be indistinguishable in physical structures. In the embodiments of the present disclosure, in order to be distinguished from a gate electrode of the transistor which is used as a control terminal, one of the two electrodes is directly described as a first electrode and the other of the two electrodes is described as a second electrode. The first electrode and the second electrode of all or a part of the transistors in the embodiment of the present disclosure are interchangeable as required. In the embodiments of the present disclosure, the first electrode is the source electrode and the second electrode is the drain electrode, which is taken as an example to describe the present disclosure.

The embodiments of the present disclosure provide a compensation circuit, a manufacturing method thereof, a pixel circuit, a compensation device and a display device, so as to solve the problem that actual light-emitting currents do not meet the design requirements due to gate-source voltages of different driving transistors having large difference when the same data voltage is applied to different driving transistors.

FIG. 1 is a circuit diagram of a compensation circuit provided by an embodiment of the present disclosure. The compensation circuit provided by the embodiments of the present disclosure may be electrically connected to all sub-pixels in a pixel simultaneously. For example, the compensation circuit comprises at least two sense transistors, and the at least two sense transistors are in one-to-one correspondence with at least two sub-pixels in a pixel. For clarity, FIG. 1 illustrates an example in which the compensation circuit is connected to one sub-pixel.

For example, colors of light emitted by the at least two sub-pixels corresponding to the at least two sense transistors are different from each other.

It should be noted that the number of sense transistors in the compensation circuit and the number of sub-pixels in a pixel may be identical.

For example, the compensation circuit can be applied in an organic light emitting diode (OLED) display panel.

Referring to FIG. 1, the compensation circuit comprises a sense transistor T0. The sense transistor T0 is electrically connected to a driving transistor of a corresponding sub-pixel. For example, the compensation circuit further comprises a sense line 100. The sense line 100 is configured to be electrically connected to driving transistors of at least two sub-pixels, and each sense transistor T0 is connected between the driving transistor of the corresponding sub-pixel and the sense line 100. The sense line 100 is configured to provide a reference voltage to a second electrode of each sense transistor T0.

It should be noted that the compensation circuit may further comprises at least two sense lines 100. The at least two sensing lines 100 correspond to the at least two sense transistors T0. One sensing line 100 may correspond to a plurality of sense transistors T0, or one sensing line 100 may also correspond to only one sense transistor T0. The reference voltages provided by the at least two sensing lines 100 are identical, but the present disclosure is not limited thereto, the reference voltages provided by the at least two sensing lines 100 may also be different, the embodiments of the present disclosure has no limitation in this aspect.

An embodiment of the present disclosure further provides a pixel circuit. The pixel circuit comprises the compensation circuit as described in any one of the embodiments of the present disclosure and at least two sub-pixel circuits that are in one-to-one correspondence with the at least two sense transistors of the compensation circuit. In each pixel, each sub-pixel comprises a sub-pixel circuit and a light emitting element (e.g., the OLED as shown in FIG. 1).

Referring to FIG. 1, each of the sub-pixel circuits comprises a driving transistor T1, a data writing transistor T2 and a capacitor C. The driving transistor T1 corresponds to the sense transistor T0. The data writing transistor T2 is configured to write a data voltage to a gate electrode of the corresponding driving transistor T1, and the capacitor C is configured to store the data voltage and maintain the data voltage at the gate electrode of the corresponding driving transistor T1.

Referring to FIG. 1, in each of the sub-pixel circuits, a first electrode of the sense transistor T0 is electrically connected to a first electrode of the driving transistor T1, a second electrode of the sense transistor T0 is electrically connected to a sensing line 100, and a gate electrode of the sense transistor T0 is configured to receive a first driving signal Gate0. The first electrode of the driving transistor T1 (a point S in FIG. 1) is also electrically connected to an anode of an OLED, and a second electrode of the driving transistor T1 (a point D in FIG. 1) is electrically connected to a first power supply Vdd, and the gate electrode of the driving transistor T1 (a point G in FIG. 1) is electrically connected to a first electrode of the data writing transistor T2. A gate electrode of the data writing transistor T2 is electrically connected to a gate line G1, and a second electrode of the data writing transistor T2 is electrically connected to a data line D to receive a data voltage. One terminal of the capacitor C is electrically connected to the first electrode of the driving transistor T1 (the point S in FIG. 1), and the other terminal of the capacitor C is electrically connected to the gate electrode of the driving transistor T1 (the point G in FIG. 1). A cathode of the OLED is electrically connected to a second power supply Vss.

For example, the gate line G1 is configured to provide a second driving signal Gate1 to the gate electrode of the data writing transistor T2 during the data writing phase.

For example, the sense transistor T0, the driving transistor T1, and the data writing transistor T2 may all be thin film transistors, or field effect transistors, or other switching devices having the same characteristics. The thin film transistors may include polysilicon (low temperature polysilicon or high temperature polysilicon) thin film transistors, amorphous silicon thin film transistors, oxide thin film transistors, organic thin film transistors, etc.

It should be noted that the pixel circuit has a 3T1C structure, which is taken as an example to describe the embodiments of the present disclosure, but the pixel circuit of the embodiments of the present disclosure is not limited to the 3T1C structure. For example, the pixel circuit may further comprises a transfer transistor, a detection transistor, and a reset transistor, and the like as required.

Figure 2:
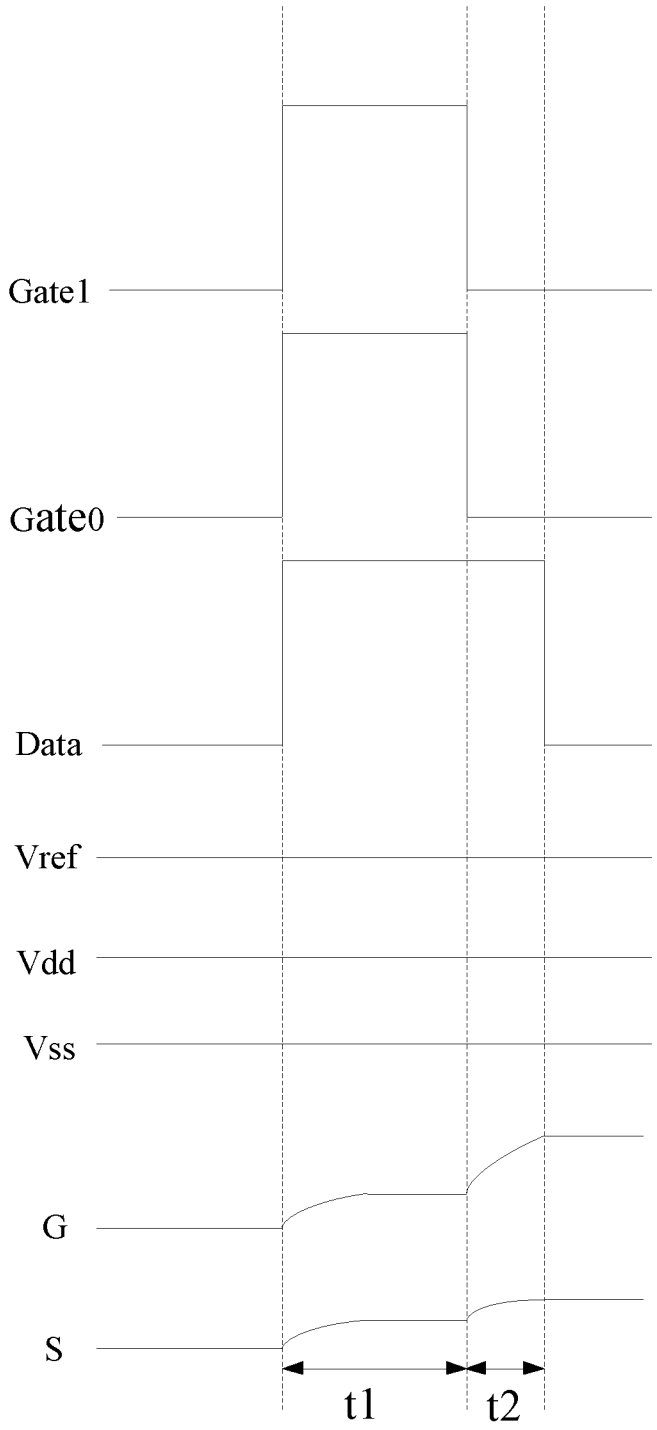
FIG. 2 is a timing diagram provided by an embodiment of the present disclosure.

FIG. 2 is a timing diagram of a driving signal provided for the compensation circuit in FIG. 1. Referring to FIG. 2, in a data writing phase t1, a second driving signal Gate1 applied to the gate electrode of the data writing transistor T2 and a first driving signal Gate0 applied to the gate electrode of the sense transistor T0 are at a high level, so that the data writing transistor T2 and the sense transistor T0 are both turned on. Meanwhile, the data line D writes the data voltage Data to the gate electrode of the driving transistor T1 through the data writing transistor T2, and the sense line 100 writes the reference voltage Vref to the first electrode of the driving transistor T1 through the sense transistor T0. As the voltage at the point G increases, a current flows through the driving transistor T1, resulting in that the voltage at the point S also increases. In a light-emitting phase t2, because the driving signal Gate1 of the data writing transistor T2 and the driving signal Gate0 of the sense transistor T0 fall to a low level, the data writing transistor T2 and the sense transistor T0 are gradually turned off. During an initial period in the light-emitting phase t2, a current still flows through the OLED via the driving transistor T1, which drives the OLED to emit light, so the voltage at the point S continues to increase. As the voltage at the point S increases, the voltage at the point G also increases.

In the present disclosure, a magnitude relationship between the channel width-to-length ratios of the driving transistors of any two sub-pixels of the at least two sub-pixels is identical with a magnitude relationship between channel width-to-length ratios of the two sense transistors corresponding to the two sub-pixels. That is, in one pixel, the sense transistor having a large channel width-to-length ratio of corresponds to the driving transistor having a large channel width-to-length ratio, and the sense transistor having a small channel width-to-length ratio corresponds to the driving transistor having a small channel width-to-length ratio. During the data writing phase t1, the amplitude of the voltage increase at the point S of each sub-pixel in the pixel is substantially identical according to this design, that is, finally the Vgs of each sub-pixel in the pixel is substantially identical; in a light emitting phase t2, the current for driving the OLED to emit light is substantially linearly proportional to the current of the data writing phase t1. Because the Vgs of each of the sub-pixels is substantially the same in the data writing phase t1, the light-emitting currents for each sub-pixel will not be affected by the difference in the voltage increases at the point S in the light-emitting phase t2, but are only related to the channel width-to-length ratios of the driving transistors of respective sub-pixels.

Figure 3:
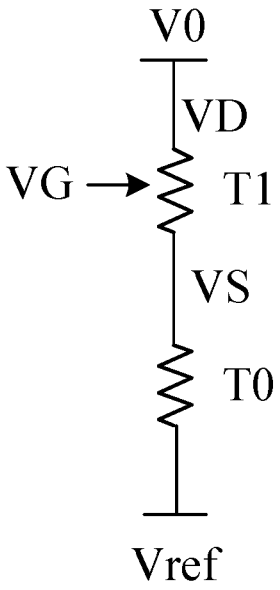
FIG. 3 is an equivalent circuit diagram of a driving transistor and a sense transistor in a data writing phase provide by an embodiment of the present disclosure.

FIG. 3 is an equivalent circuit diagram of a driving transistor and a sense transistor in a data writing phase provided by an embodiment of the present disclosure. Referring to FIG. 3, because the equivalent resistor of the driving transistor T1 and the equivalent resistor of the sense transistor T0 are connected in series in the data writing phase t1, thus $I_{T1}=I_{T0}$, where $I_{T1}$ represents a current flowing through the driving transistor T1, and $I_{T0}$ represents a current flowing through the sense transistor T0. During the data writing phase t1, the driving transistor T1 operates in a saturation region, so $I_{T1}=\mu CoxW1(2L1)(Vgs1-Vth1)^2$, where Vgs1 is the gate-source voltage of the driving transistor T1, and Vth1 is the threshold voltage of the driving transistor T1, μ is the carrier mobility, Cox is the gate oxide capacitance per unit area, W1 and L1 are the channel width and the channel length of the driving transistor T1 respectively; during the data writing phase t1, the sense transistor T0 operates in the linear region, so $I_{T0}=\mu CoxW0/(2L0)(2(Vgs0-Vth0)Vds0-Vds0^2)$, where Vgs0 is the gate-source voltage of the sense transistor T0, Vds0 is the source-drain voltage of the sense transistor T0, and Vth0 is the threshold voltage of the sense transistor T0, W0 and L0 are the channel width and the channel length of the sense transistor T0 respectively. The voltages applied at two ends of the two equivalent resistors connected in series are the power supply voltage V0 and the reference voltage Vref respectively, and the power supply voltage V0 and the reference voltage Vref are fixed for different sub-pixels, and Vgs1, Vgs0, and Vds0 are all identical with each other under the same data voltage for different sub-pixels, and therefore, only in the event that W0/L0 is directly proportional to W1/L1, it can be ensured that the increase amounts at the source points S of the driving transistors T1 are substantially the same.

In the compensation circuit, the magnitude relationship between the channel width-to-length ratios of the sense transistors is designed to be identical with the magnitude relationship between the channel width-to-length ratios of the driving transistors, so that the compensation circuit solves the problem of the large difference between the gate-source voltages. Specifically, the driving transistor and the sense transistor are connected in series, and the voltages applied to the two transistors (the driving transistor and the sense transistor) proportionally correspond to the ratio between the resistances of the two transistors, and the resistance of the transistor corresponds to the channel width-to-length ratio, so that a driving transistor with a relatively large channel width-to-length ratio corresponds to a sense transistor with a relatively large channel width-to-length ratio, so that the difference in the channel width-to-length ratios does not cause large difference in the source electrode voltages of the driving transistors, thereby solving the problem that the difference in the gate-source voltages of different driving transistors is relatively large upon each sub-pixel being driven by the same data voltage.

Figure 4:
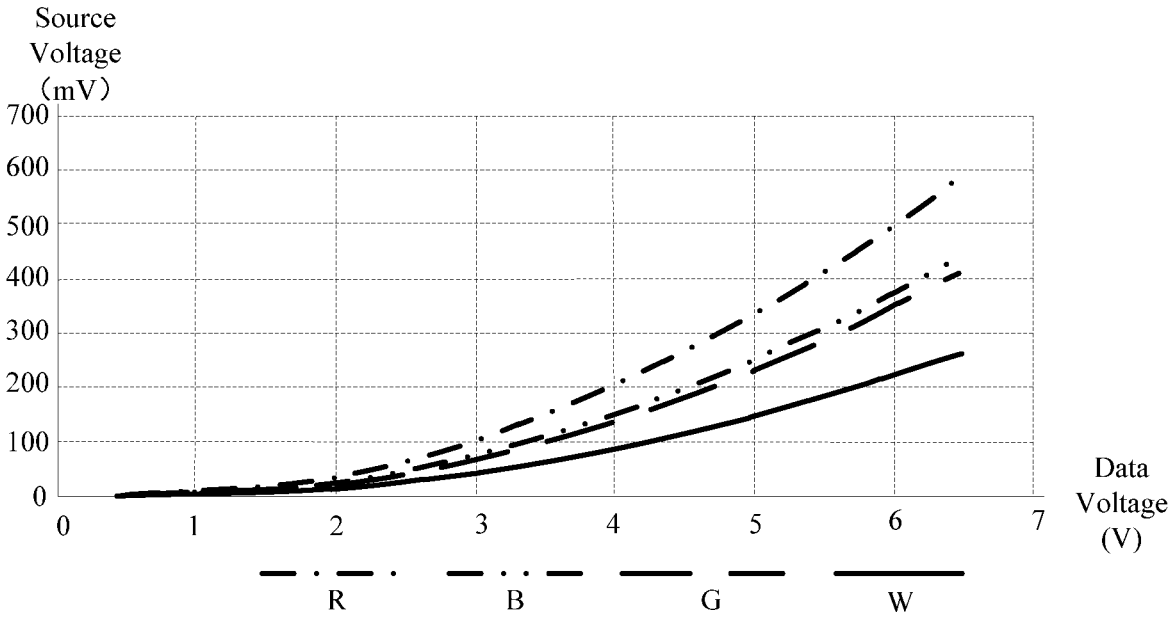
FIG. 4 is a diagram illustrating a relationship between a data voltage and a source voltage of a driving transistor provided by an embodiment of the present disclosure.
Figure 5:
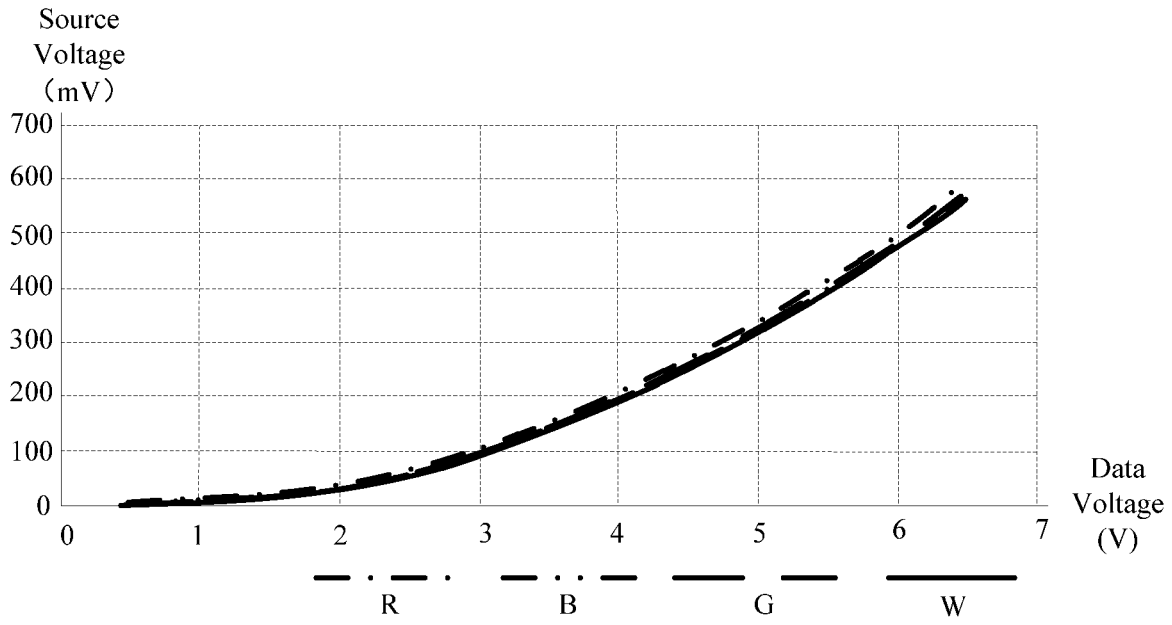
FIG. 5 is a diagram illustrating a relationship between another data voltage and a source voltage of a driving transistor provided by an embodiment of the present disclosure.

The compensation circuit above will be described by taking a pixel comprising four sub-pixels as an example below. For example, each pixel comprises a R(red) sub-pixel, a G(green) sub-pixel, a B(blue) sub-pixel and a W(white) sub-pixel. When the same sense transistor is adopted, the correspondence relationships between the data voltage and the source voltages of the driving transistors are illustrated in FIG. 4. When the sense transistor provided by the present disclosure is adopted, the correspondence relationships between the data voltage and the source voltages of the driving transistors are illustrated in FIG. 5. Referring to FIG. 4 and FIG. 5, when the sense transistor provided by the present disclosure is adopted, the source voltages of each sub-pixels can be substantially identical when the same data voltage is applied, thereby ensuring that the Vgs of the driving transistors of the respective sub-pixels are substantially identical.

When actually designing the channel width-to-length ratio of the sense transistor, in addition to considering the ratio A between the channel width-to-length ratios of the driving transistors in each sub-pixel, a secondary effect is also considered, that is, the influence of the transistor itself on the channel width-to-length ratio. For example, the saturation region current formula and the linear region current formula are ideal without considering the secondary effect. The secondary effect may include a second-order effect of the transistor (for example, the second-order effect may include a sub-threshold effect, a channel length modulation effect, etc.), and the like. Therefore, in the actual operation process, a secondary effect adjustment factor B needs to be added in consideration of the secondary effect. That is to say, in the actual design, the relationship between the ratio K between the channel width-to-length ratios of the two sense transistors and the ratio A between the channel width-to-length ratios of the two driving transistors corresponding the two sense transistors is: K=A+B. However, because B here is not necessarily the same for different sense transistors, and B may be positive or negative, K varies within a range, which can be specifically expressed as follows:

The ratio between the channel width-to-length ratios of the driving transistors of any two sub-pixels is A, and the ratio between the channel width-to-length ratios of the sense transistors corresponding to the two sub-pixels is in a range of [A−a, A+a], where A is a positive number, and $|A-1|>a>0$. The difference in the gate-source voltages of different driving transistors can be reduced when the ratio K between the channel width-to-length ratios of the sense transistors is in the range of [A−a, A+a].

For example, an optimum value of the ratio between the channel width-to-length ratios of the two sense transistors corresponding to the two sub-pixels is related to the design and the manufacturing process of the device, the optimum value can be obtained in the range of [A−a, A+a] in an analog manner, and specific description can be referred in the embodiment of the manufacturing method described below. In order to ensure that the optimum value can be obtained, a can take a relatively large value, so as to ensure that the above range is wide enough, such as a can be $|A-1|/2$, or $3|A-1|/4$.

The following table illustrates the channel width-to-length ratios of the sense transistors of each sub-pixels in one pixel which enable the source voltages of the driving transistors not to increase significantly when the same data voltage is written to the driving transistors of each sub-pixels.

| | W1/L1 | W1/L1' | W0/L0 | W0/L0' |
|---|---|---|---|---|
| R | 17.5 | 2.5 | 16 | 2.67 |
| G | 11.5 | 1.64 | 10.25 | 1.71 |
| B | 12.5 | 1.79 | 11.25 | 1.88 |
| W | 7 | 1.00 | 6 | 1.00 |

Referring to the table, W1/L1 represents the channel width-to-length ratios of the driving transistors of different sub-pixels, and W1/L1' represents the ratio between the channel width-to-length ratio of the driving transistor of each sub-pixel and the channel width-to-length ratio of the driving transistor of the white sub-pixel. W0/L0 represents the channel width-to-length ratios of the sense transistors of different sub-pixels, and W0/L0' represents the ratio between the channel width-to-length ratio of the sense transistor of each sub-pixel and the channel width-to-length ratio of the sense transistor of the white sub-pixel. For example, A may be W1/L1', and K may be W0/L0'. It can be seen that the values of K and A are substantially identical, but also have a difference, and the ratios between the channel width-to-length ratios of the sense transistors are slightly larger than the ratios between the channel width-to-length ratios of the driving transistors. The difference between K and A can represent the secondary effect adjustment factor B of different sense transistors.

After determining the ratios between the channel width-to-length ratios of the sense transistors of each sub-pixels in the pixel, the channel width-to-length ratio of each sense transistor may be determined based on the ratios above. The channel width-to-length ratio of each sense transistor should be within the design range (i.e., [A−a, A+a]) when determining the channel width-to-length ratio of each sense transistor, this design range can ensure that each sense transistor can be manufactured by a manufacture process, and can prevent the manufactured sense transistor from being too large to be manufactured in the pixel region.

Figure 6:
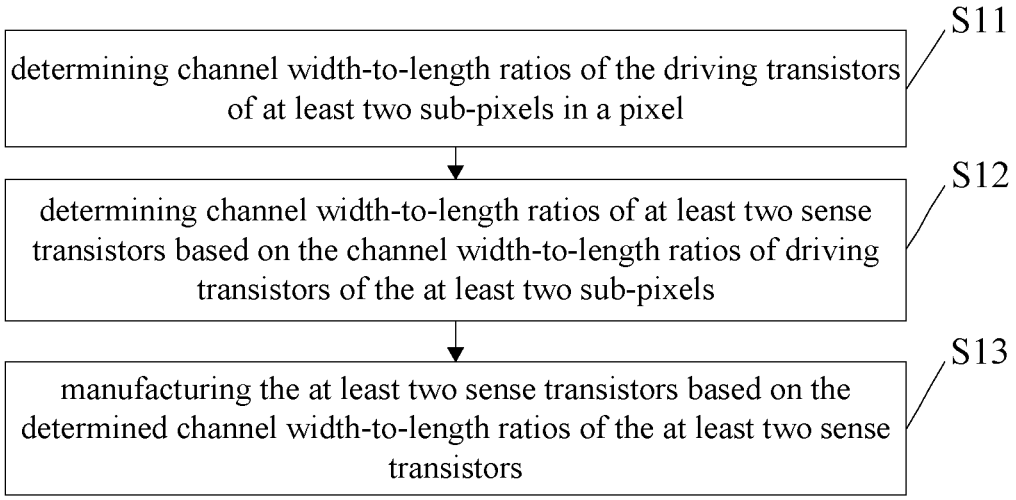
FIG. 6 is a flow chart of a method of manufacturing a compensation circuit provide by an embodiment of the present disclosure.

FIG. 6 is a flow chart of a manufacturing method of a compensation circuit provided by an embodiment of the present disclosure. Referring to FIG. 6, the manufacturing method includes:

Step S11: determining channel width-to-length ratios of the driving transistors of at least two sub-pixels in a pixel.

For example, the channel width-to-length ratio of the driving transistor of each sub-pixel can be determined as follows:

Determining the light-emitting efficiency of each sub-pixel in the same pixel; determining ratios between light-emitting currents of the sub-pixels based on the ratios between the light-emitting efficiencies of the sub-pixels; determining ratios between channel width-to-length ratios of the driving transistors of the sub-pixels based on the ratios between the light-emitting currents of the sub-pixels; determining the channel width-to-length ratios of the driving transistors of the sub-pixels based on the ratios between the channel width-to-length ratios of the driving transistors and a pixel region area corresponding to each pixel.

For example, the light-emitting efficiency of the sub-pixel may also be the light absorption rate of the color film of the sub-pixel, for example, the light absorption rate of the color film of the red sub-pixel, the light absorption rate of the color film of the blue sub-pixel and the light absorption rate of the color film of the green sub-pixel are different. Therefore, in order to compensate the difference in the light absorption rate, the sub-pixel with a high light absorption rate needs to actually emit more light, and the light-emitting current is larger, and the sub-pixel with a low light absorption rate needs to actually emit less light, and the light-emitting current is smaller.

Step S12: determining channel width-to-length ratios of at least two sense transistors based on the channel width-to-length ratios of driving transistors in the at least two sub-pixels, where the at least two sense transistors are in one-to-one correspondence with the at least two sub-pixels, a first electrode of each of the sense transistors is electrically connected to the driving transistor of the corresponding one of the sub-pixels, a magnitude relationship between the channel width-to-length ratios of driving transistors of any two sub-pixels of the at least two sub-pixels is identical with a magnitude relationship between the channel width-to-length ratios of two sense transistors corresponding to the two sub-pixels.

In an implementation of the embodiment of the present disclosure, the ratio between the channel width-to-length ratios of the driving transistors of any two sub-pixels is A, and the ratio between the channel width-to-length ratios of the sense transistors corresponding to the two sub-pixels is in a range of [A−a, A+a], where A is a positive number and $|A-1|>a>0$. The difference in the gate-source voltages of different driving transistors can be reduced in the event that the ratio between the channel width-to-length ratios of the sense transistors is within the range of [A−a, A+a].

In an implementation of the embodiment of the present disclosure, the driving transistors of the at least two sub-pixels are electrically connected to the same sense line, and each sense transistor is electrically connected between the driving transistor of the corresponding one of the sub-pixels and the sense line, the sense line is configured to provide a reference voltage to a second electrode of each sense transistor.

After determining the ratio between the channel width-to-length ratios of the sense transistors of the sub-pixels in the pixel, the channel width-to-length ratio of each sense transistor may be determined based on the ratio above. When determining the channel width-to-length ratio of each sense transistor, the channel width-to-length ratio of each sense transistor should be in the design range (i.e., [A−a, A+a]). This design range can ensure that each sense transistor can be manufactured by a manufacturing process, and can prevent the manufactured sense transistor from being too large to be manufactured in the pixel region.

For example, the manufacturing method of the compensation circuit may comprise: selecting an optimal value through a simulation experiment. In an example, the compensation circuit may comprise a first sense transistor and a second sense transistor. The manufacturing method of the compensation circuit comprises: taking values sequentially in [A−a, A+a] by a set step size; designing analog circuits by sequentially using each of the values as a ratio between a channel width-to-length ratio of the first sense transistor to a channel width-to-length ratio of the second sense transistor, wherein in the analog circuit, a ratio of a channel width-to-length ratio of a first driving transistor corresponding to the first sense transistor to a channel width-to-length ratio of a second driving transistor corresponding to the second sense transistor is A; and determining an optimal ratio among the ratios by adopting the analog circuits.

For example, taking values sequentially in [A−a, A+a] by a set step size means that: taking values in [A−a, A+a] in sequence from large to small or from small to large as ratios, where the difference between two adjacent ratios is the set step size. For example, the first ratio selected may be A−a or A+a. The set step size may be a/100~a/50, which, on one hand, can ensure that the numbers of the values can be enough, so that the optimal value can be obtained, and on the other hand, can avoid excessive values making simulation tests too complicated.

For example, determining the optimal ratio among the ratios by adopting the analog circuits may comprise: writing a data voltage group to the first driving transistor and the second driving transistor respectively for each ratio, wherein the data voltage group comprises a plurality of different data voltages; determining a source voltage group of the first driving transistor corresponding to the data voltage group and a source voltage group of the second driving transistor corresponding to the data voltage group; generating a curve between the data voltage group and the source voltage group of the first driving transistor and a curve between the data voltage group and the source voltage group of the second driving transistor respectively; selecting a ratio corresponding to a case that the two curves have the highest coincidence degree as the optimal ratio among the ratios. The high coincidence degree of the curve indicates that the difference in the gate-source voltages of different driving transistors is the smallest, so the corresponding ratio can make the actual light-emitting current meet the design requirements.

For another example, each data voltage corresponds to a reference voltage, so in the above simulation process, when each data voltage is written, a reference voltage corresponding thereto is written to the sense line. The correspondence between the reference voltage and the corresponding data voltage may be stored in advance in a memory. The writing the data voltage group to the first driving transistor and the second driving transistor for each ratio respectively may comprise: determining a reference voltage group corresponding to the data voltage group based on a correspondence between data voltages and reference voltages; writing a reference voltage corresponding to a data voltage of the data voltage group to the sense line upon writing the data voltage to the first driving transistor and the second driving transistor respectively.

Step S13, manufacturing the at least two sense transistors based on the determined channel width-to-length ratios of the at least two sense transistors.

The compensation circuit manufactured by the manufacturing method can solve the problem that the difference in the gate-source voltages is large by designing a magnitude relationship between the channel width-to-length ratios of the sense transistors to be identical with a magnitude relationship between the channel width-to-length ratios of the driving transistors. For example, the driving transistor and the sense transistor are connected in series, and the voltages applied to the two transistors (the driving transistor and the sense transistor) correspond to the ratio between the resistances of the two transistors, and the resistance of the transistor corresponds to the channel width-to-length ratio.

Therefore, the driving transistor having a relatively large channel width-to-length ratio corresponds to the sense transistor having a relatively large channel width-to-length ratio, and a difference between channel width-to-length ratios does not cause a relatively large difference between the source electrode voltages of the driving transistors, thereby solving the problem that the difference in the gate-source voltages of different driving transistors is relatively large upon each sub-pixel being driven by the same data voltage.

Figure 7:
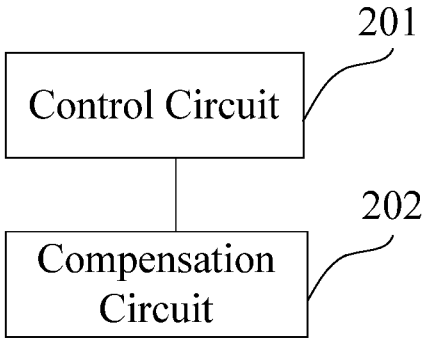
FIG. 7 is a schematic structural diagram of a compensation device provided by an embodiment of the present disclosure.

FIG. 7 is a schematic structural diagram of an OLED compensation device provided by an embodiment of the present disclosure. Referring to FIG. 7, the compensation device comprises a control circuit 201 and a compensation circuit 202 as described above. The control circuit 201 and the compensation circuit 202 are electrically connected. Because the compensation device comprises the compensation circuit 202 as described above, the same technical effects as the compensation circuit can be achieved, that is, solving the problem that the difference in the gate-source voltages of different driving transistors is relatively large upon each sub-pixel being driven by the same data voltage.

In an implementation of an embodiment of the present disclosure, the control circuit 201 may comprise an integrated circuit (IC) chip, such as a timing controller (TCON).

Figure 8A:
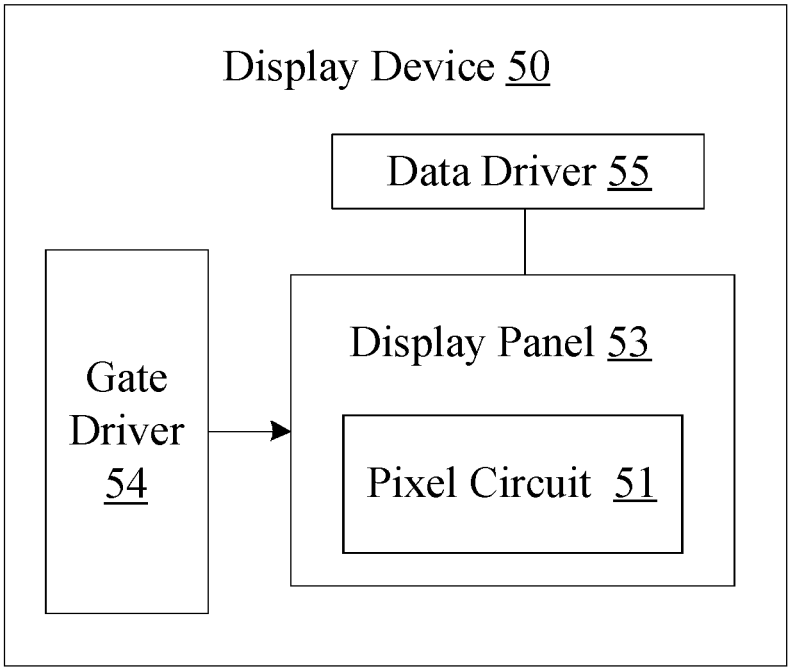
FIG. 8A is a schematic block diagram of a display device provided by an embodiment of the present disclosure.
Figure 8B:
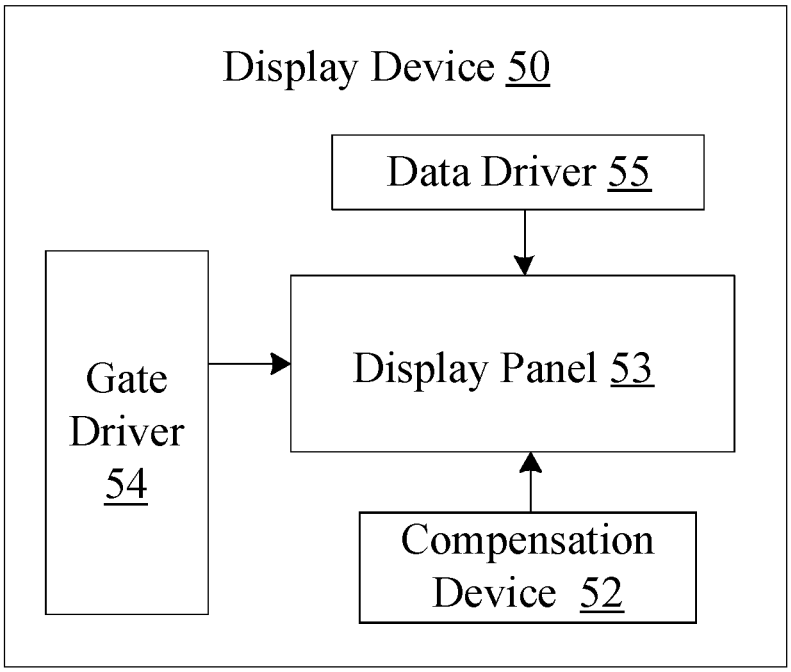
FIG. 8B is a schematic block diagram of another display device provided by an embodiment of the present disclosure.

An embodiment of the present disclosure also provides a display device. FIG. 8A is a schematic block diagram of a display device provided by an embodiment of the present disclosure; FIG. 8B is a schematic block diagram of another display device provided by an embodiment of the present disclosure.

Referring to FIG. 8A, the display device 50 provided by an embodiment of the present disclosure may comprise a pixel circuit 51 as mentioned above. Alternatively, referring to FIG. 8B, the display device 50 provided by an embodiment of the present disclosure may also comprise a compensation device 52 as mentioned above.

For example, referring to FIGS. 8A and 8B, the display device 50 may further comprise a display panel 53, a gate driver 54 and a data driver 55. The display panel 53 is configured to display images. The gate driver 300 is configured to supply a second driving signal to the gate electrode of the driving transistor in the pixel circuit 51 through the gate line, thereby controlling the driving transistor to be turned on or off. The data driver 55 is configured to supply a data voltage to the display panel 53 through the data line.

In a specific implementation, the display device provided by an embodiment of the present disclosure may be any product or component having a display function, such as a mobile phone, a tablet computer, a television, a display, a notebook computer, a digital photo frame, a navigator, and the like.

Because the display device comprises the compensation device as mentioned above, the same technical effects as the compensation device can be achieved, that is, solving the problem that the difference in the gate-source voltages of different driving transistors is relatively large upon each sub-pixel being driven by the same data voltage.

The beneficial effects of the technical solutions provided by the embodiments of the present disclosure include:

The magnitude relationship between the channel width-to-length ratios of the sense transistors is designed to be identical with the magnitude relationship between the channel width-to-length ratios of the driving transistors, so as to solve the problem that the gate-source voltage difference is large; the driving transistor and the sense transistor are connected in series, the voltages applied to the two transistors (the driving transistor and the sense transistor) correspond to the ratio between the resistances of the two transistors, and the resistance of the transistor corresponds to the channel width-to-length ratio, so that the driving transistor having a relatively large channel width-to-length ratio corresponds to the sense transistor having a relatively large channel width-to-length ratio, and a difference between channel width-to-length ratios does not cause a relatively large difference between the source electrode voltages of the driving transistors, thereby solving the problem that the difference in the gate-source voltages of different driving transistors is relatively large upon each sub-pixel being driven by the same data voltage.

What have been described above are only the possible embodiments of the present disclosure, and are not intended to limit the present disclosure. Any modifications, equivalents, improvements, etc., which are within the spirit and scope of the present disclosure, are intended to be included within the scope of the present disclosure.

What is claimed is:

1. A compensation circuit, comprising at least two sense transistors, wherein the at least two sense transistors are in one-to-one correspondence to at least two sub-pixels in a pixel, and a first electrode of each of the sense transistors is directly and electrically connected to a driving transistor of corresponding one of the sub-pixels; and a magnitude relationship between channel width-to-length ratios of driving transistors of any two sub-pixels of the at least two sub-pixels is identical with a magnitude relationship between channel width-to-length ratios of two sense transistors corresponding to the two sub-pixels.

2. The compensation circuit according to claim 1, further comprising a sense line, wherein the sense line is configured to be electrically connected to driving transistors of the at least two sub-pixels, each of the sense transistors is electrically connected between the driving transistor of the corresponding one of the sub-pixels and the sense line, and the sense line is configured to provide a reference voltage to a second electrode of each of the sense transistors.

3. The compensation circuit according to claim 1, wherein a ratio between the channel width-to-length ratios of the driving transistors of the two sub-pixels is A, and a ratio between the channel width-to-length ratios of the two sense transistors corresponding to the two sub-pixels is in a range of [A−a, A+a], where A is a positive number, and |A−1>a>0.

4. The compensation circuit according to claim 1, wherein colors of light emitted by the two sub-pixels are different from each other.

5. A method of manufacturing a compensation circuit, comprising:

determining channel width-to-length ratios between driving transistors of at least two sub-pixels in a pixel;

determining channel width-to-length ratios of at least two sense transistors based on the channel width-to-length ratios of the driving transistors of the at least two sub-pixels, wherein the at least two sense transistors are in one-to-one correspondence to the at least two sub-pixels, a first electrode of each of the sense transistors is directly and electrically connected to a driving transistor of corresponding one of the sub-pixels, and a magnitude relationship between channel width-to-length ratios of driving transistors of any two sub-pixels of the at least two sub-pixels is identical with a magnitude relationship between channel width-to-length ratios of two sense transistors corresponding to the two sub-pixels; and manufacturing the at least two sense transistors based on the determined channel width-to-length ratios of the at least two sense transistors.

6. The method according to claim 5, wherein the driving transistors of the at least two sub-pixels are electrically connected to a same sense line, each of the sense transistors is electrically connected between the driving transistor of the corresponding one of the sub-pixels and the sense line, and the sense line is configured to provide a reference voltage to a second electrode of each of the sense transistors.

7. The method according to claim 5, wherein a ratio between the channel width-to-length ratios of the driving transistors of the two sub-pixels is A, and a ratio between the channel width-to-length ratios of the two sense transistors corresponding to the two sub-pixels is in a range of [A−a, A+a], where A is a positive number, and $|A-1|>a>0$.

8. The method according to claim 7, wherein the at least two sense transistors comprise a first sense transistor and a second sense transistor, the method further comprises:

taking values sequentially in [A−a, A+a] by a set step size;

designing analog circuits by sequentially using each of the values as a ratio between a channel width-to-length ratio of the first sense transistor and a channel width-to-length ratio of the second sense transistor, wherein in each of the analog circuits, a ratio of a channel width-to-length ratio of a first driving transistor corresponding to the first sense transistor to a channel width-to-length ratio of a second driving transistor corresponding to the second sense transistor is A; and determining an optimal ratio among the values by adopting the analog circuits.

9. The method according to claim 8, wherein determining the optimal ratio among the values by adopting the analog circuits comprises:

writing a data voltage group to the first driving transistor and the second driving transistor respectively for each ratio, wherein the data voltage group comprises a plurality of different data voltages;

obtaining a source voltage group of the first driving transistor corresponding to the data voltage group and a source voltage group of the second driving transistor corresponding to the data voltage group;

generating a curve between the data voltage group and the source voltage group of the first driving transistor and a curve between the data voltage group and the source voltage group of the second driving transistor respectively; and selecting a ratio corresponding to a case that the two curves have a highest coincidence degree as the optimal ratio among the values.

10. The method according to claim 9, wherein writing the data voltage group to the first driving transistor and the second driving transistor respectively for each ratio comprises:

determining a reference voltage group corresponding to the data voltage group based on a correspondence between the data voltages and reference voltages; and writing a reference voltage corresponding to a data voltage of the data voltage group to the sense line upon writing the data voltage to the first driving transistor and the second driving transistor respectively.

11. A pixel circuit, comprising the compensation circuit according to claim 1 and driving transistors of the at least two sub-pixels which are in one-to-one correspondence with the at least two sense transistors.

12. The pixel circuit according to claim 11, wherein each of the at least two sub-pixels further comprises: a data writing transistor and a capacitor, the data writing transistor is configured to write a data voltage to a gate electrode of a driving transistor corresponding to the data writing transistor, and the capacitor is configured to store the data voltage and maintain the data voltage at the gate electrode of the driving transistor corresponding to the capacitor.

13. The pixel circuit according to claim 12, wherein in each of the at least two sub-pixels, a first electrode of the driving transistor is electrically connected to a first electrode of a sense transistor corresponding to the driving transistor, and a second electrode of the driving transistor is electrically connected to a first power supply, and a gate electrode of the driving transistor is electrically connected to a first electrode of the data writing transistor;

a gate electrode of the data writing transistor is electrically connected to a gate line, a second electrode of the data writing transistor is configured to receive the data voltage; and a terminal of the capacitor is electrically connected to the first electrode of the driving transistor, and a remaining terminal of the capacitor is electrically connected to the gate electrode of the driving transistor.

14. A compensation device, comprising a control circuit and the compensation circuit according to claim 1, wherein the control circuit is electrically connected to the compensation circuit.

15. The compensation device according to claim 14, wherein the control circuit comprises an integrated circuit chip.

16. A display device, comprising the pixel circuit according to claim 11.

17. A display device, comprising the compensation device according to claim 14.

18. The method according to claim 6, wherein a ratio between the channel width-to-length ratios of the driving transistors of the two sub-pixels is A, and a ratio between the channel width-to-length ratios of the two sense transistors corresponding to the two sub-pixels is in a range of [A−a, A+a], where A is a positive number, and $|A-1|>a>0$.

19. The method according to claim 18, wherein the at least two sense transistors comprise a first sense transistor and a second sense transistor, the method further comprises:

taking values sequentially in [A−a, A+a] by a set step size;

designing analog circuits by sequentially using each of the values as a ratio between a channel width-to-length ratio of the first sense transistor and a channel width-to-length ratio of the second sense transistor, wherein in each of the analog circuits, a ratio of a channel width-to-length ratio of a first driving transistor corresponding to the first sense transistor to a channel width-to-length ratio of a second driving transistor corresponding to the second sense transistor is A; and determining an optimal ratio among the values by adopting the analog circuits.

20. The method according to claim 19, wherein determining the optimal ratio among the values by adopting the analog circuits comprises:

writing a data voltage group to the first driving transistor and the second driving transistor respectively for each ratio, wherein the data voltage group comprises a plurality of different data voltages;

obtaining a source voltage group of the first driving transistor corresponding to the data voltage group and a source voltage group of the second driving transistor corresponding to the data voltage group;

generating a curve between the data voltage group and the source voltage group of the first driving transistor and a curve between the data voltage group and the source voltage group of the second driving transistor respectively; and selecting a ratio corresponding to a case that the two curves have a highest coincidence degree as the optimal ratio among the values.

* * * * *